US005099641A

United States Patent [19]

Igel et al.

[11] Patent Number: 5,099,641

[45] Date of Patent: Mar. 31, 1992

[54] METHOD AND APPARATUS FOR EXCHANGING ROVING BOBBINS

[75] Inventors: Wolfgang Igel, Ebersbach/Fils; Ivo Righi, Fellbach, both of Fed. Rep. of Germany

[73] Assignee: Zinser Textilmaschinen GmbH, Ebersbach/Fils, Fed. Rep. of Germany

[21] Appl. No.: 519,885

[22] Filed: May 7, 1990

Related U.S. Application Data

[63] Continuation of Ser. No. 254,470, Oct. 6, 1988, abandoned.

[30] Foreign Application Priority Data

Oct. 9, 1987 [DE] Fed. Rep. of Germany ..... 3734275

[51] Int. Cl.[5] ..... D01H 9/18

[52] U.S. Cl. ..... 57/281; 57/90

[58] Field of Search ..... 57/261, 266, 267, 268, 57/270, 273, 275, 281

[56] References Cited

U.S. PATENT DOCUMENTS

| | | | |
|---|---|---|---|
| 4,438,622 | 3/1984 | Pens | 57/281 X |
| 4,464,893 | 8/1984 | Zingel | 57/267 |
| 4,753,065 | 6/1988 | Mack et al. | 57/266 |
| 4,799,353 | 1/1989 | Kawasaki et al. | 57/281 |
| 4,899,531 | 2/1990 | Mack | 57/281 |

FOREIGN PATENT DOCUMENTS

| | | | |
|---|---|---|---|
| 213962 | 3/1987 | European Pat. Off. | 57/281 |
| 2438247 | 2/1975 | Fed. Rep. of Germany . | |
| 2158657 | 3/1976 | Fed. Rep. of Germany . | |
| 17852 | 5/1985 | Japan | 57/281 |
| 1533 | 1/1986 | Japan | 57/281 |

*Primary Examiner*—Joseph J. Hail, III

*Attorney, Agent, or Firm*—Shefte, Pinckney & Sawyer

[57] ABSTRACT

A method and apparatus for exchanging a bobbin on a bobbin holder of a spinning machine for a full bobbin stored on a spare bobbin frame of the spinning machine. The apparatus is in a service unit for the spinning machine and includes an intermediate support apparatus and a grip element movable between the bobbin holder, the spare bobbin frame and the supporting apparatus for sequentially transferring a full bobbin or a bobbin on the bobbin holder to the intermediate support apparatus, transferring a bobbin directly between the bobbin holder and the spare bobbin frame and transferring a bobbin on the intermediate support apparatus to the bobbin holder or the spare bobbin frame. The gripper element includes a vertically movable frame having a plurality of spindles for mounting bobbins thereon and the frame is rotatable in response to vertical movement thereof so the frame can be selectively moved along a path corresponding to the adjacent contour of the spinning machine.

5 Claims, 5 Drawing Sheets

METHOD AND APPARATUS FOR EXCHANGING ROVING BOBBINS

This is a continuation of co-pending application Ser. No. 254,470, filed Oct. 6, 1988 now abandoned.

BACKGROUND OF THE INVENTION

The present invention relates to a method and apparatus for exchanging full roving bobbins, which are held ready on a ring spinning machine, for empty or nearly empty roving bobbins on the ring spinning machine. More specifically the present invention relates to a method and apparatus for automatically exchanging roving bobbins with the aid of a traveling service unit movable to the stations of the ring spinning machine.

When a roving bobbin which feeds yarn to a ring spinning machine is empty, the bobbin must be exchanged for the spinning process to continue. It is possible to allow the yarn from the roving bobbin to fully run out before exchanging the bobbin for a full roving bobbin; however, the yarn from the new roving bobbin must then be fed into the ring spinning machine before the spinning process can continue. Preferably the roving bobbin is exchanged before it is completely unwound, for it is then possible to piece the roving from the full roving bobbin with the roving from the nearly empty bobbin so that the spinning process can continue uninterrupted.

In European published Patent Application No. 0 213 962, a method and an apparatus for simultaneously exchanging full and empty roving bobbins is described and includes two sets of gripping elements. One set of gripping elements removes the full roving bobbin from the spare bobbin frame and holds it while the other set of gripping elements removes the empty bobbin from the roving bobbin holder. The two sets of gripping elements then operate simultaneously to move the empty bobbin onto the spare bobbin frame and the full bobbins to the bobbin holder. However, as this method requires that the gripping elements be simultaneously moved past each other, complex movement paths are inherent, adding to the equipment and production costs of the spinning process. Moreover, this known method and apparatus is only adapted to service the outermost row of bobbins on the roving bobbin holder so that the inner row of empty bobbins must be brought outward to the outer row position in order to then be exchanged for full bobbins. This requirement to position the bobbins to be exchanged in the outermost row adds as well to the equipment and production costs.

In German Patent A-24 38 247, a roving bobbin exchange apparatus is described and includes two similarly outfitted service units which sequentially service the spinning stations. The gripping element of one service unit takes the full roving bobbins from the spare bobbin frame and holds them ready while the other service unit removes the empty bobbins. In German Patent B-21 58 657, a method for exchanging full roving bobbins for empty bobbins is described and includes a so-called block exchange in which all of the bobbins of one side of a machine are simultaneously exchanged. However, this method requires the use of apparatus built onto the ring spinning machine itself for initially moving the empty bobbins to an intermediate position during the time that the full bobbins are loaded onto the roving bobbin holder and this limits the adaptability of this method.

Accordingly, the need exists for a method and apparatus for simply and reliably exchanging empty bobbins on a ring spinning machine for full bobbins with little or no disruption of the spinning process.

SUMMARY OF THE INVENTION

The present invention provides a method and apparatus for exchanging a bobbin on a bobbin holder of a textile spinning machine for a full bobbin stored on a spare bobbin frame of the spinning machine.

Briefly described, the present invention provides a method including the steps of transferring the full bobbin from the spare bobbin frame to a service unit adjacent the spinning machine, transferring the bobbin on the bobbin holder of the spinning machine directly to the spare bobbin frame and transferring the full bobbin from the service unit to the bobbin holder of the spinning machine.

The present invention also provides a method for exchanging a bobbin on a bobbin holder of a spinning machine for a full bobbin stored on a spare bobbin frame of a spinning machine including the steps of transferring the bobbin on the bobbin holder of the spinning machine to a service unit adjacent the spinning machine, transferring the full bobbin from the spare bobbin frame directly to the bobbin holder of the spinning machine and transferring the bobbin on the service unit to the spare bobbin frame.

In one preferred embodiment of the apparatus provided by the present invention, an apparatus in a service unit for a spinning machine for exchanging bobbins on a bobbin holder of the spinning machine for full bobbins on a spare bobbin frame of the spinning machine includes means for temporarily supporting a bobbin and means, movable between the bobbin holder, spare bobbin frame and the supporting means for sequentially transferring a full bobbin from the spare bobbin frame to the supporting means, transferring a bobbin directly from the bobbin holder to the spare bobbin frame and transferring the full bobbin from the supporting means to the bobbin holder.

In another embodiment of the apparatus of the present invention, an apparatus in a service unit for a spinning machine for exchanging bobbins on a bobbin holder of the spinning machine for full bobbins on a spare bobbin frame of the spinning machine includes means for temporarily supporting a bobbin and means, movable between the bobbin holder, the spare bobbin frame and the supporting means, for sequentially transferring a bobbin from the bobbin holder to the supporting means, transferring a full bobbin directly from the spare bobbin frame to the bobbin holder and transferring the bobbin from the supporting means to the spare bobbin holder.

Preferably, the apparatus in one preferred embodiment of the invention includes means for maintaining bobbins in vertical orientation during each transferring.

In one preferred embodiment of the apparatus of the present invention, the transferring means includes a vertical movable member, a frame pivotably mounted on the vertically movable member, means for pivoting the frame with respect to the vertically movable member, means on the frame for engaging, holding and releasing bobbins for transfer.

The invention will now be explained and described in more detail with reference made to the examples of embodiment shown in the drawings.

DETAILED DESCRIPTION OF THE PREFERRED EMBODIMENTS

Figure 1:
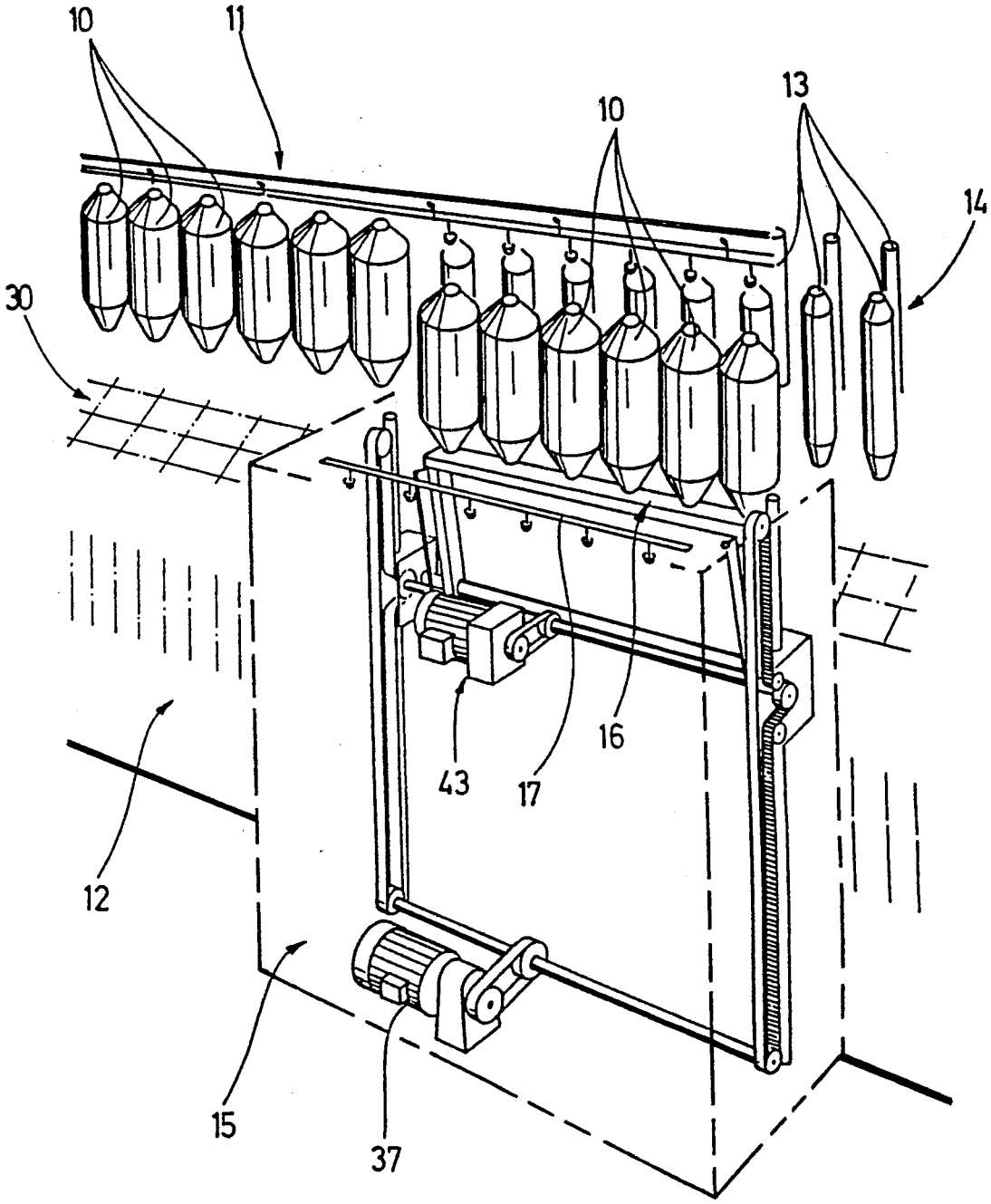
FIG. 1 is a schematic representation of a portion of a ring spinning machine and a service unit for exchanging bobbins, showing the bobbin exchange apparatus of one preferred embodiment of the present invention.

As shown in FIG. 1, a ring spinning machine 12 includes a roving bobbin holder 14 in which two parallel rows of bobbins 13 are hung while their yarn is fed through a drafting apparatus 30. The roving bobbin holder 14 includes conventional creels in which the tubes of the bobbins 13 are inserted. Positioned above and outwardly from the roving bobbin holder 14 is a spare bobbin frame 11 having a plurality of creels into which the tubes of a plurality of full roving bobbins 10 are inserted. The creels of the spare bobbin frame 11 are movable along rail elements of the spare bobbin frame 11.

When the yarn from the bobbins 13 has completely or nearly completely been unwound from the bobbins and fed into the drafting apparatus 30, the bobbins are replaced with the full bobbins 10 stored on the spare bobbin frame 11. This exchange process can be carried out with the aid of a service unit 15 which is movable, in a known manner, along the length of the ring spinning machine to service groups of adjacent spinning stations. The service unit 15, schematically represented in FIG. 1, is adapted to install a group of six full bobbins 10 into six adjacent spinning stations. The service unit 15 includes a vertically movable member such as a pivoted frame 16 which is adapted to grip and support six full bobbins 10 or six empty bobbins 13. For this purpose, the frame 16 is provided with peg-like grip elements 18 insertable into the bottom of the tubes of the full bobbins 10 and the empty bobbins 13 and movable upwardly to drive the bobbins supported thereon upward so that the creels upon which they are suspended open and thereby release the bobbins therefrom. Similarly, the grip elements 18 are movable downwardly so that bobbins previously supported thereon hang from the creels upon which they have been inserted by the grip elements 18. The service unit 15 also includes an intermediate support apparatus 17 having a corresponding number of creels for temporarily storing the full bobbins 10 or the empty bobbins 13 during the exchange process. The pivoted frame 16 sequentially transfers bobbins directly from the intermediate support apparatus 17 to the roving bobbin holder 14 and directly from the intermediate support apparatus 12 to the spare bobbin frame 11.

Figure 2:
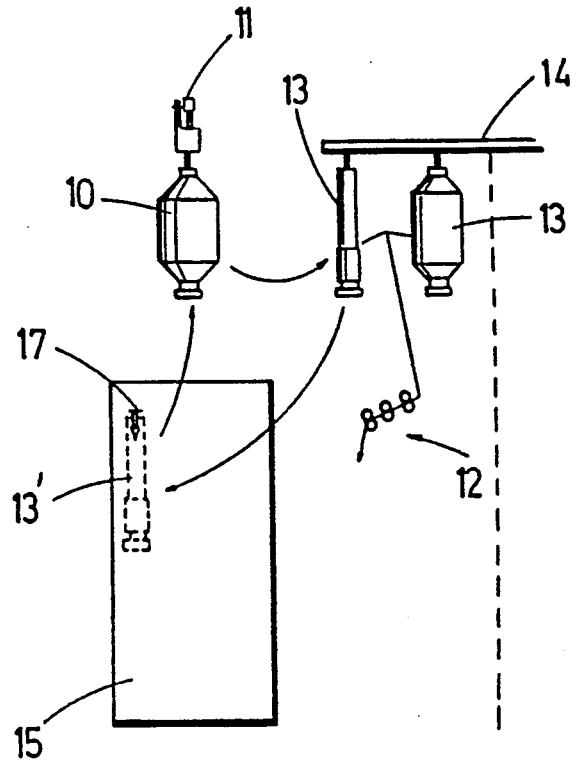
FIG. 2 is a schematic representation of one form of bobbin exchange sequence according to one embodiment of the present invention.
Figure 3:
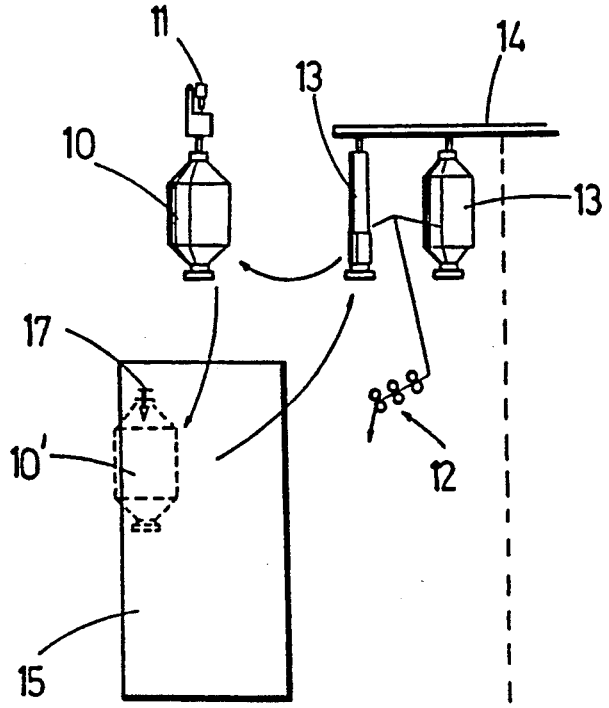
FIG. 3 is a schematic representation of another for of bobbin exchange sequence according to another embodiment of the present invention.

The process for exchanging the full bobbins 10 for the empty bobbins 13 can be executed in a variety of ways, two of which are illustrated in FIGS. 2 and 3. In FIG. 2, the empty bobbins 13 are removed from the roving bobbin holder 14 and temporarily stored, as depicted by the position 13', on the intermediate support assembly 17 of the service unit 15. Thereafter, the grip elements 18 remove the full bobbins 10 from the spare bobbin frame 11 and move these directly onto the same creels of the roving bobbin holder 14 on which the empty bobbins 13 were previously suspended. The grip elements 18 are then moved to again grip the empty bobbins 13 in their temporary storage position 13' and move them to the spare bobbin frame 11 from which they are later removed. However, in the above-described sequence of exchanging the bobbins, it is difficult to avoid breakage of the yarn from the empty bobbin 13 and such breakage adds significant time to the spinning process, since the yarn must again be reinserted into the drafting apparatus of the machine.

Another exchange sequence by which the exchange of bobbins can occur is illustrated in FIG. 3. Initially, the grip elements 18 remove the full bobbins 10 from the spare bobbin frame 11 and insert these bobbins on the intermediate support assembly 17, in the position designated 10', for temporary storage thereon. Then, the grip elements 18 remove the empty bobbins 13 from the roving bobbin holder 14 and move them directly onto the spare bobbin frame 11. Since the spare bobbin frame 11 is higher than the roving bobbin holder 14, it is possible to remove the empty bobbins 13 from the roving bobbin holder 14 and insert them on the spare bobbin frame 11 without the yarn from these bobbins breaking. Accordingly, it is possible to piece the yarn ends from the full bobbins 10 with the yarn from the empty bobbins 13 so that the spinning process of the ring spinning machine 12 can continue uninterrupted.

Figure 4:
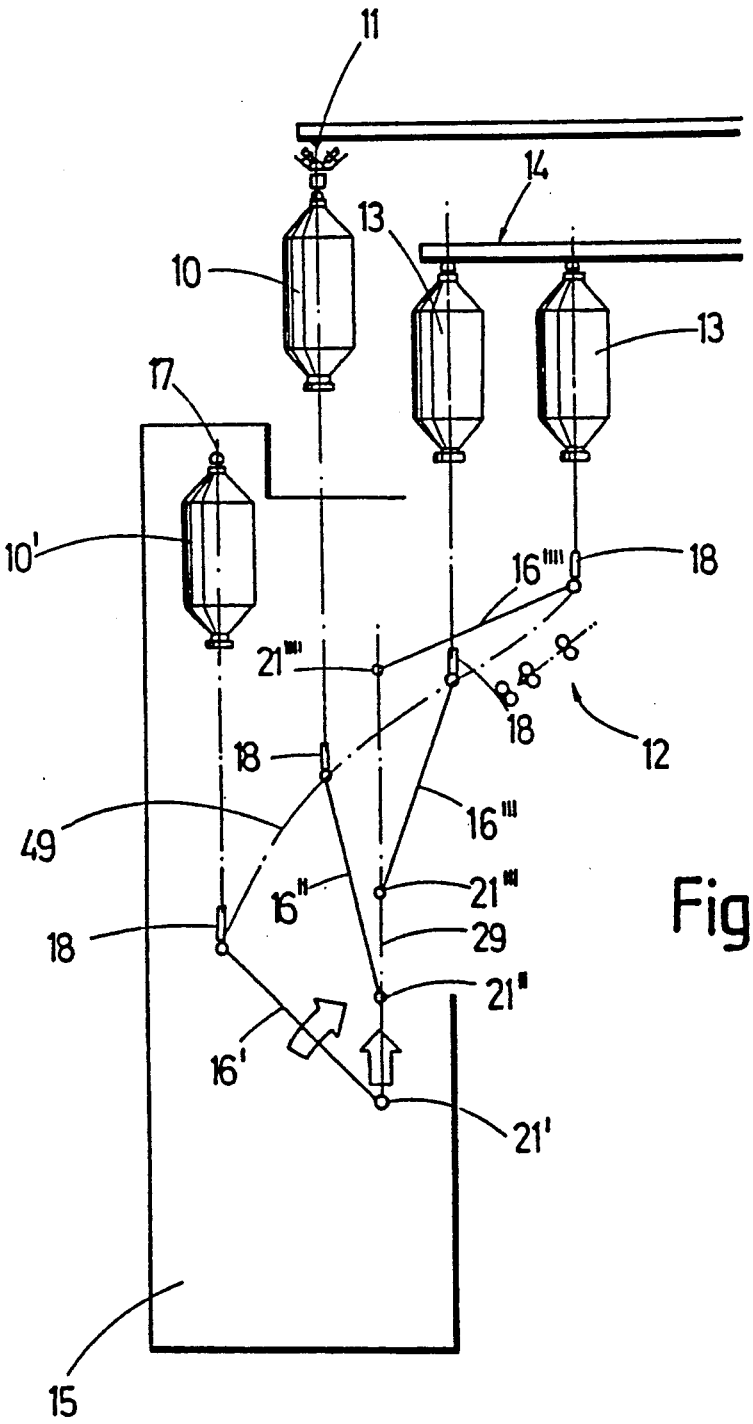
FIG. 4 is a schematic representation of the movements of an exchange apparatus on a service unit according to the present invention.
Figure 5:
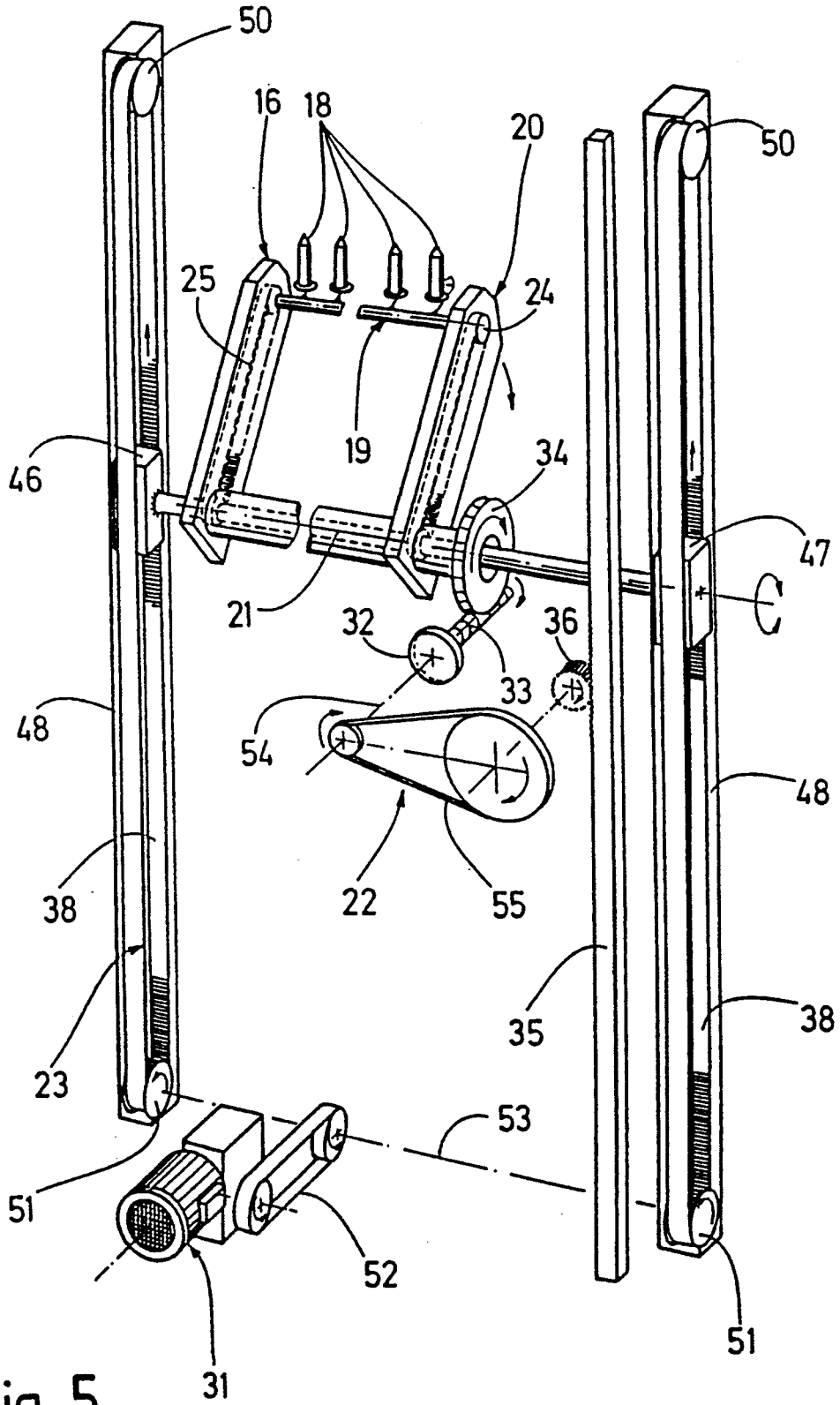
FIG. 5 is a perspective view of another preferred embodiment of the bobbin exchange apparatus of the present invention.

As shown schematically in FIG. 4, the grip elements 18 on the service unit 15 can be moved to service the inner row of empty bobbins 13 as well. The two bobbin exchange sequences described with respect to FIGS. 2 and 3 can be executed by a service unit provided with the grip elements 18 illustrated in FIG. 4. With further reference to the components for moving the grip elements 18, the pivoted frame 16 is mounted on a cross shaft 21 which is rotatably mounted in a vertical movement apparatus 29 for vertical movement with respect to the service unit 15. As shown in FIG. 5, the grip elements 18 are mounted on a shaft 19 rotatably secured in the frame 16 parallel to the cross shaft 21 and having an axis 24. The grip elements 18 maintain their predetermined vertical orientation during pivoting of the frame 16 about the cross shaft 21 through corresponding rotation of the shaft 19. Through the compound movement of the frame 16 produced by the rotation of the cross shaft 21 during its vertical movement by the vertical movement apparatus 29, the frame 16 is moved along an extended cycloid path 49 which follows the outwardly facing contour of the ring spinning machine 12, to move the grip elements 18 into position to be inserted into the inner row of empty bobbins 13. The grip elements 18 and the frame 16 are accordingly moved through the following positions during the bobbin exchange process. Initially, the frame 16 is positioned in the position designated 16'' and the grip elements 18 are vertically aligned with the cores of the full bobbins 10 suspended thereabove on the spare bobbin frame 11. Subsequently, the vertical movement apparatus 29 moves the frame 16 upward to insert the grip elements 18 into the cores of the full bobbins 10 and continues moving until the bobbins are sufficiently raised to be released from the creels of the spare bobbin frame 11. Thereafter, the vertical movement apparatus 29 lowers the frame 16 until the cross shaft 21 has reached the position designated 21' whereupon the frame 16 pivots outward to the position 16'. During the pivoting of the frame 16, the shaft 19 of the grip elements 18 correspondingly pivots to maintain the grip elements 18, with the full bobbins 10 supported thereon, in a constant vertical orientation. With the frame 16 in the position 16', the axes of the full bobbin 10 are in vertical alignment with the creels of the intermediate support assembly 17 so that the frame 16 can then be moved upward by the vertical movement apparatus 29 to insert the full bobbins 10 onto the intermediate support assembly 17 for temporary storage thereon.

The frame 16 is then moved downward so the grip elements 18 clear the full bobbins 10 suspended on the intermediate support assembly 17 and is subsequently pivoted about the cross shaft 21 in coordination with vertical movement of the cross shaft to follow the path 49 to the position designated 16''', if the outer row of empty bobbins 13 is to be exchanged, or to the position designated 16'''', if the inner row of empty bobbins 13 is to be exchanged. Additionally, the shaft 19 pivots with respect to the frame 16 to bring the grip elements 18 into vertical alignment with the empty bobbins 13 suspended thereabove. Thereafter, the grip elements 18 are inserted into the bottom of the cores of the bobbins 13 by vertical movement of the frame 16. Subsequently, the empty bobbins 13 are removed from the roving bobbin holder 14 and the frame 16 pivots on the cross shaft 21 to move the empty bobbins 13, which are supported on the grip elements 18, into vertical alignment with the empty creels on the spare bobbin frame 11. Thereafter, the frame 16 is moved upward by the vertical movement apparatus 29 to insert the empty bobbins 13 onto the creels of the spare bobbin frame 11. The grip elements 18 are then lowered and pivoted outward to reengage the full bobbins 10 temporarily stored on the intermediate support assembly 17.

Upon their release from the intermediate support assembly 17, the full bobbins 10 supported on the grip elements 18 are then moved, through coordinated movement of the frame 16 about the cross shaft 21 and the vertical movement of the axle, into position for insertion onto the empty creels of the roving bobbin holder 14. The bobbin exchange process is completed by the insertion of the full bobbins 10 onto the creels of the roving bobbin holder 14.

In FIG. 5, one embodiment of an assembly for moving the frame 16 is schematically illustrated. In this embodiment, the frame 16 includes a frame 20 having a hub mounted rotatably to the cross shaft 21. One axial end of the cross shaft 21 is rotatably mounted in a support member such as a block 46 and the other axial end is mounted in a block 47. The blocks 46 and 47 are each operatively connected to an interconnecting means such as a pair of toothed belts 38 vertically supported in an assembly 48 and driven by drive gears 51 through belt pulleys 50. Each drive gear 51 is mounted on a drive shaft 53 which is rotated by a drive belt 52 drivingly coupled to a motor 31. The blocks 46 and 47 are thus vertically moved through the rotation of their respective belts 38 about their drive gears 51 and belt pulleys 50.

The frame 20 has a worm gear 34 fixedly coupled thereto and driven by a worm 33. A driven clutch plate 32 is mounted to one axial end of the worm 33 and is selectively driven by a drive clutch plate 54 of a clutch drive apparatus 22. The clutch drive apparatus 22 is mounted by a frame (not shown) to blocks 46 and 47 and includes a drive belt 55 drivingly coupling the drive clutch plate 54 to a pulley mounted to a pinion gear 36 which meshes with a rack 35 oriented parallel to the belts 38. Accordingly, motor 31 can be operated to move the blocks 46 and 47 and the clutch drive apparatus 22 up or down by the rotation of the toothed belts 38. The pinion gear 36 rotates with respect to the rack 35 during vertical movement of the clutch drive apparatus 22 and its rotational movement transferred to the drive clutch plate 54 by the drive belt 55. The rotational movement of the shaft can be selectively transferred to the worm 33 by engagement of the drive clutch plate 54 with the clutch plate 32. The rotation of the worm 33 produces a corresponding rotation of the worm gear 34 and the frame 20. Thus, operation of the motor 31 produces simultaneous vertical and pivotal movement of the frame 20.

To maintain the vertical orientation of the grip elements 18 during pivoting of the frame 20, the shaft 19 has a gear on each axial end which is driven by a toothed belt 25 extending around a corresponding gear mounted on the cross shaft 21. Accordingly, the shaft 19 rotates about its axis 24 in coordination with rotation of the frame 20 about the cross shaft 21.

Figure 6:
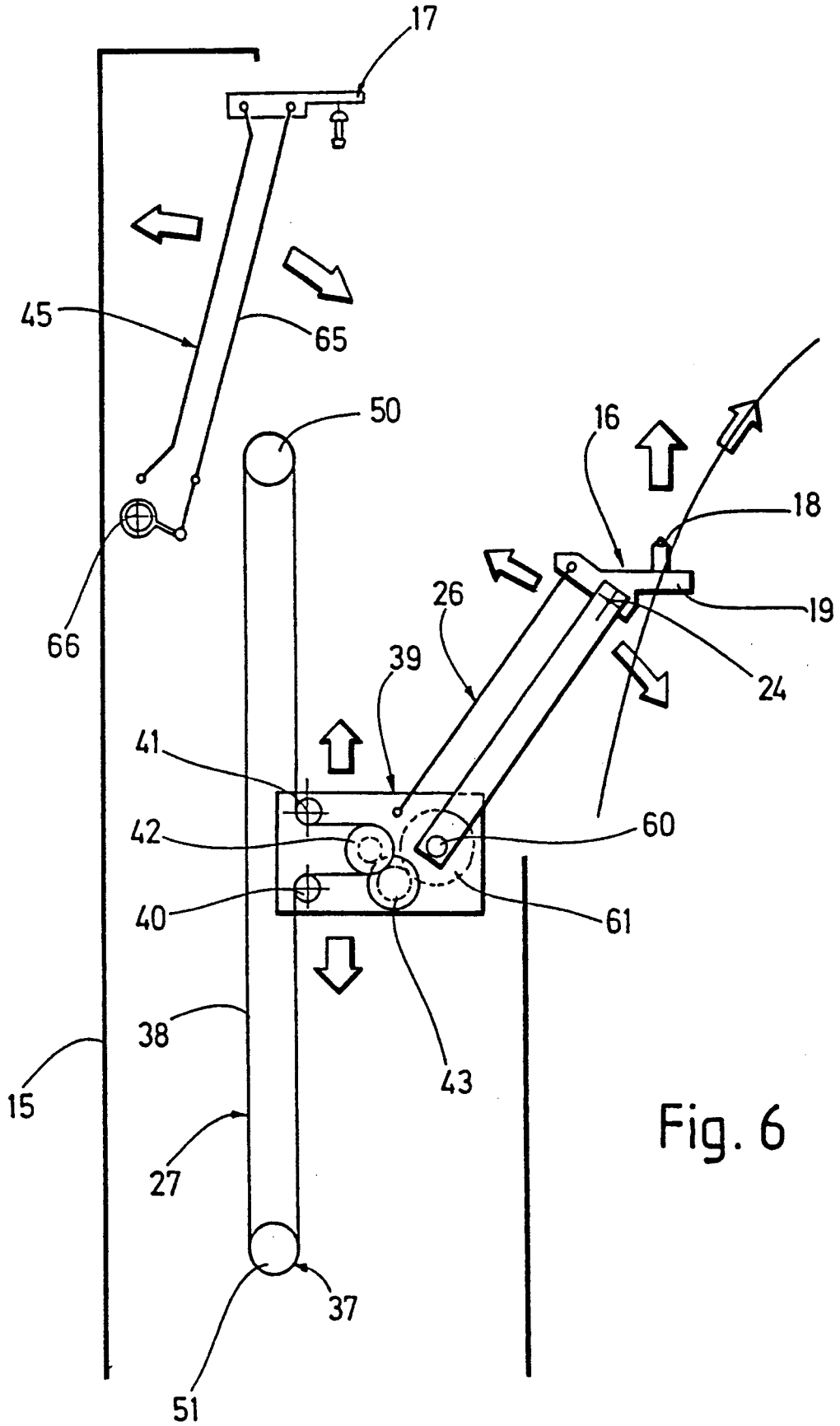
FIG. 6 is a schematic representation of the movements of an exchange apparatus of a modified form of the apparatus illustrated in FIG. 5.

In FIG. 6, another embodiment of the lifting apparatus of the present invention includes a shaft 60 to which the frame 16 is fixedly mounted. The shaft 60 is rotatably mounted in a pair of spaced, support members 39, only one of which is schematically represented in FIG. 6. The support members 39 has a pair of idler rollers 40 and 41 and a gear 42 spaced inwardly from the rollers. A toothed endless belt 38 is trained around the rollers and meshes with the gear 42. The belt 38 is also trained around a roller 50 and a drive gear 51 which drives the belt. The support means 39 moves with the belt when the gear 42 is fixed relative to the belt.

A drive motor 43 mounted to the support member 39 has a pair of drive gears mounted on its shaft. One gear meshes with an intermediate gear mounted on the shaft on which the gear 42 rotates. The other gear meshes with a hub gear 61 mounted on the shaft 60. Operation of the drive motor 43 accordingly produces rotation of the gear 42 to move the support member 39 relative to the belt 38. Simultaneously, the operation of the motor produces pivoting of the frame 16 through the rotation of the hub gear 61. Accordingly, the frame 16 is simultaneously pivoted and vertically moved during the operation of the motors 43. Additionally, the operation of the drive gear 51 simultaneously with the operation of the motors 43 produces compound vertical movement of the support members 39.

As can be understood, the lifting apparatus illustrated in FIG. 6 enables the frame 16 to be moved along the path 49 through selective operation of the various drive motors.

In a modification of the embodiment shown in FIG. 6, the intermediate support assembly 17 is provided with means for translationally moving bobbins including a parallelogram assembly 45 having a arm 65 pivotably coupled to a link rotatable about an axis 66 and another arm parallel to the arm 65 which is pivotably coupled at one end to the service unit 15 and at its other end to the intermediate support assembly 17. Through this parallelogram apparatus 45, the intermediate support assembly can be moved to a position in which its creels are in vertical alignment with the bobbins supported therebelow on the grip elements 18. Once the bobbins have been inserted onto its creels, the intermediate support apparatus can be moved back to its initial, outer position shown in FIG. 1.

In some circumstances, the grip elements 18, which are normally maintained in a same vertical orientation during the movement of the frame 16 along the path 49, must be pivoted to differing vertical orientations to permit the bobbins thereon to clear the ring spinning machine. For this purpose, a drive motor (not shown) can be mounted in one of the blocks 46 or 47 to rotate the cross shaft 21 about its axis. Through the above-described coupling between the shaft 19 and the cross shaft 21 by the toothed belts 25, the rotation of the cross shaft 21 is transmitted to the shaft 19 to thereby alter the vertical orientation of the grip elements 18.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a service unit for traveling along a spinning machine, apparatus for exchanging bobbins on a bobbin holder of the spinning machine for full bobbins on a spare bobbin conveying means, the bobbin holder and the spare bobbin conveying means being laterally spaced from one another, said service unit comprising:

means for temporarily holding at least one bobbin; and means for transferring at least one bobbin, said means including a single bobbin support member and means for moving said bobbin support member between the bobbin holder, the spare bobbin conveying means and said temporary bobbin holding means, said support member being operable to sequentially transfer a full bobbin supported on said bobbin support member from said spare bobbin conveying means to said temporary bobbin holding means, laterally transfer a bobbin supported on said bobbin support member from said bobbin holder to said spare bobbin conveying means and laterally transfer said full bobbin from said temporary bobbin holding means to said bobbin holder.

2. In a service unit for a spinning machine an apparatus according to claim 1 and characterized further in that said transferring means includes means for transferring rows of pluralities of bobbins.

3. In a service unit for a spinning machine, an apparatus according to claim 1 characterized further in that said transferring means includes means for maintaining the bobbins in vertical orientation during each transferring.

4. In a service unit for a spinning machine, an apparatus according to claim 3 and characterized further in that said transferring means includes a vertical movable member, a frame pivotably mounted on said vertically movable member, means for pivoting said frame with respect to said vertically movable member, means on said frame for engaging, holding and releasing bobbins for transfer, and said means for maintaining vertical orientation is mounted on said frame.

5. In a service unit for a spinning machine, an apparatus according to claim 4 and characterized further in that said bobbin engaging, holding and releasing means includes a plurality of spindles for supporting a plurality of bobbins thereon.

* * * * *